US006419454B1

(12) United States Patent
Christiansen

(10) Patent No.: US 6,419,454 B1
(45) Date of Patent: Jul. 16, 2002

(54) AIR COMPRESSOR CONTROL SEQUENCER

(76) Inventor: Leo P. Christiansen, 713 Mohican Ct., Mendota Heights, MN (US) 55120

( * ) Notice: Subject to any disclaimer, the term of this patent is extended or adjusted under 35 U.S.C. 154(b) by 0 days.

(21) Appl. No.: 09/594,228

(22) Filed: Jun. 14, 2000

(51) Int. Cl.[7] ..... F04B 41/06; F04B 49/00; F04B 49/06

(52) U.S. Cl. ..... 417/4; 417/5; 417/7; 417/8; 417/12; 417/53; 417/44.2; 417/44.4

(58) Field of Search ..... 417/4, 5, 7, 8, 417/12, 53, 44.2, 44.4

(56) References Cited

U.S. PATENT DOCUMENTS

| | | | | | |
|---|---|---|---|---|---|
| 2,295,775 | A | * | 9/1942 | Crittenden | 417/12 |
| 2,312,728 | A | * | 3/1943 | O'Hagan et al. | 417/12 |
| 3,251,534 | A | * | 5/1966 | Strecker | 417/12 |
| 4,152,902 | A | | 5/1979 | Lush | |
| 4,502,842 | A | * | 3/1985 | Currier et al. | 417/8 |
| 4,580,947 | A | * | 4/1986 | Shibata et al. | 417/8 |
| 4,799,864 | A | | 1/1989 | Hockley | |
| 5,325,884 | A | * | 7/1994 | Mirel et al. | 137/110 |
| 5,440,891 | A | | 8/1995 | Hindmon, Jr. et al. | |
| 5,460,009 | A | | 10/1995 | Wills et al. | |
| 5,921,090 | A | | 7/1999 | Jurewicz et al. | |
| 6,266,952 | B1 | * | 7/2001 | Choroszylow et al. | 417/5 |

* cited by examiner

*Primary Examiner*—Michael Koczo
*Assistant Examiner*—Timothy P. Solak
(74) *Attorney, Agent, or Firm*—Nikolai & Mersereau, P.A.

(57) ABSTRACT

A controller for managing a plurality of compressors in an efficient manner such that the system uses less energy, has lower maintenance cost and experiences less wear. For a system with multiple compressors the controller has the minimum number of compressors needed to maintain the pressure on at any given time and has no more than one compressor running in an unloaded condition for maximum efficiency. The system can quickly pressure up or down in conjunction with the needs of the system. The controller rotates the order of use of the compressors to spread the time of use and for limiting the number of times during an hour that each compressor can be turned on such that the compressors take turns running and turning on and off for even wear. The system seldom uses more than one compressor unloaded at any time. The timers for adding or shedding motors or loads can descend from long to short time delays when necessary so that the compressors can cycle to the correct pressure for the loads faster and save energy by shutting down faster and avoiding an extra compressor being on when it should have timed out, thus saving energy. The system uses both pressure and rates of change of pressure to decide if motors and loads should be added and shed. The system also has varying response times due to larger or smaller of change of pressures for greater efficiency in energy use.

18 Claims, 12 Drawing Sheets

ADD MOTOR FLOW DIAGRAM

ADD LOAD FLOW DIAGRAM

SHED LOAD FLOW DIAGRAM

SHED MOTOR FLOW DIAGRAM

AIR COMPRESSOR CONTROL SEQUENCER

BACKGROUND OF THE INVENTION

1. Field of the Invention

This invention relates to a controller for managing a series of compressors to provide a head within a dead band with the most efficient use of the compressors to reduce power consumption and lower maintenance costs.

2. Description of the Related Art

When a series of compressors supply air pressure for pneumatic tools and equipment in a factory, shop or other facility, the compressors frequently have staggered, independent, set point controls, which turn on or off additional compressors, or load or unload the compressors, as the head decreases or increases. Since the compressors are not well coordinated, and the motors have long time delays before they shut off when the compressor is unloaded, two or more unloaded compressors can be running at one time, wasting energy and placing unnecessary wear on the motor and compressor.

Staggered set points are usually employed to load and unload compressors at descending and ascending pressure as its ability to sequence multiple units. It is better for the motors and compressors to start and stop a limited number of times per hour. Unless long time delays are employed on motor shut down, it will result in too many motor cycles per hour. Long time delays are therefore used resulting in wasted energy by running two or more motors unloaded at the same time.

During the day demands for air pressure will vary resulting in high amplitude sine waves of pressure in the pressure tank. With staggered set point systems the sine waves can trigger two or more compressors to unload. Since each unloading and loading will change the compressor output by about 80%, the fluctuations in pressure in the tank will change more than is required forcing more cycling than is necessary. It is generally better to follow a large change, for example 80%, with a small change, for example 20%, to smooth the fluctuations. If, however, with this prior art, the delays were simply shortened to shut down the motors to implement the 80%–20% sequence, there would still be too many motor cycles, since it is only part of the solution.

For initial starting of the compressors, individual controls on staggered set point compressors may turn on more compressors than needed during the start up for the day or in deep amplitude sine wave cycling. Most compressor systems do not keep track of how long each compressor is on and what the motor's current use is for tracking system management and cost savings statistics.

High rates of change in head may trigger several compressors to unload at the same time when there are independent set points for the compressors. Therefore several compressors may be in an unloaded state for long periods of time when the motors have long delay times. Therefore the system does not react efficiently to large changes in head.

SUMMARY OF THE INVENTION

The invention uses a controller with one set point for controlling all of the compressors in the system. The controller limits the number of compressors turned on at one time to the minimum number needed to supply the load on the system and limits the number of compressors running unloaded to one compressor at a time. This is accomplished by not only adding and shedding loads by pressure offsets but also making use of information gathered continually on the system pressure, the amount of departure from the set point and the rate of departure, its reversal rate of return to the set point, whereby a dynamic change in add or shed decisions are on-going to prevent add or shed decisions that are either late or premature. The number of compressors turned on and their load states, by this means, are coordinated to produce the most efficient use of the compressors, which saves energy and reduces wear on the compressors.

The controller uses a shorter time delay between unloading the compressor and shedding the motor for the compressor than the prior art, avoiding long periods of time with a compressor running in an inefficient unloaded state when the head has increased.

The controller avoids having two or more unloaded compressors at a time by using the special aforementioned logic. Thus the cycling of the motors and loads is minimized and the amplitudes of the sine waves of pressure differences is reduced. Limiting large numbers of start-ups and shut-downs with this method limits wear on the motors and compressors and reduces maintenance costs while saving energy.

The controller can detect rapid changes in head to shed or add compressors or loads more quickly and efficiently with dynamically changeable time delays for different rates of change in head, to keep the system near the set point and in some cases it will stop and hold the countdown to add or shed when the rate of pressure departure from the set point slows up, to determine in another brief period of time whether the loading will increase or decrease, hence more intelligent add/shed decisions are made. In most cases these last second decision changes will prevent a "short cycle".

The controller also coordinates the sequencing of the compressors such that they have approximately even numbers of run hours and start-ups. The number of motor startups per hour is counted to limit the number of motor start-ups in accordance with the compressor manufacturer's recommendations.

Where some compressors employ multiple stages of loading the controller can then load the compressor with varying degrees with the same method and obtain fine tuning for the head.

The initial start up is limited usually to one or two compressors, lowering the electrical current used and preventing unnecessary cycling prior to the plant commencement of loading the system.

The controller is easily installed on existing systems and programmed for the particular needs of the facility.

The control panel allows for ease of programming and use of either the original equipment controls or automatic controls via this invention.

OBJECTS OF THE INVENTION

It is an object of the invention to avoid having multiple compressors running unloaded at the same time.

It is an object of the invention to coordinate the operation of all compressors in a system.

It is an object of the invention to save energy in a system having a plurality of compressors.

It is an object of the invention to limit wear on the compressors.

It is an object of the invention to minimize the number of start-ups and shut-downs of the compressors.

It is an object of the invention to provide run time data for each compressor.

It is an object of the invention to alternate the lead/lag sequence of the compressors for even wear.

It is an object of the invention to let the operator select either the OEM controls, manual controls or the controller of the invention for operating the compressors.

It is an object of the invention to run the minimum number of compressors to maintain tank pressure at the set point.

It is an object of the invention to provide a controller that is easy to install on a compressor system.

It is an object of the invention to easily program the controller.

It is an object of the invention to increase the life of the motors and the compressors.

It is an object of the invention to limit the number of on/off cycles per motor during a given time period.

It is an object of the invention to keep track of motor current consumed on each motor and for the system so as to calculate the savings that the controller provides.

It is an object of the invention to limit the initial start up to one compressor or as few as will satisfy the time desired to reach the set point.

It is an object of the controller to respond more quickly in loading the compressors for higher rates of drops in pressure.

It is an object of the controller to shed compressors and loads on the compressors faster for higher rates of increases in pressure.

Other objects, advantages and novel features of the present invention will become apparent from the following detailed description of the invention when considered in conjunction with the accompanying drawing.

DESCRIPTION OF THE PREFERRED EMBODIMENTS

Figure 1:
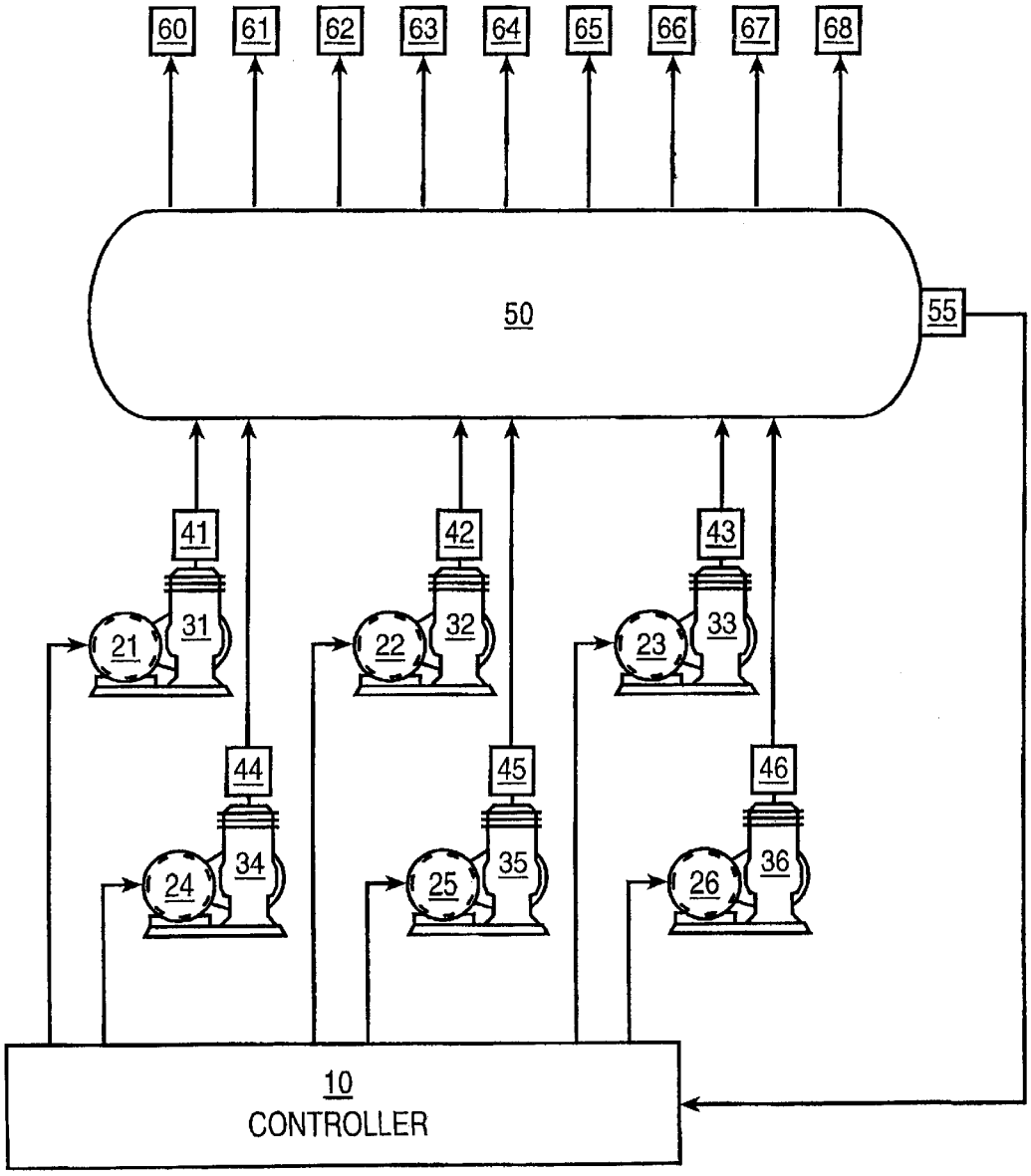
FIG. 1 is a schematic of the air compressor system.

Many tools and machines run on compressed air in factories, repair shops and other businesses. In order to have a supply of compressed air for the various users throughout a building, a series of air compressors feeding a storage tank is frequently used. The volume of compressed air used changes constantly from minute to minute throughout the day such that the number of compressors in use varies with demand. Typically there is a pressure sensor in a tank, which supplies pressure data used to control the number of compressors in use. For example, one system may be, when the pressure is below 45 psi 6 compressors are turned on, when the pressure is between 45 and 48 psi 5 compressors are on. When the pressure is between 48 and 51 psi 3 compressors are turned on and when the pressure is between 51 and 55 psi 1 compressor is turned on. In this manner the system tries to maintain the pressure in an operating range of 45 to 55 psi. If the pressure exceeds a specified extreme offset above set point, all of the compressors may be turned off. As the demand for compressed air goes up and the pressure in the tank drops the number of compressors in service goes up to meet the demand. As the demand for air pressure goes down the pressure in the tank goes up and the number of compressors in use drops. Typically these systems use the same motors in the same sequence over and over, such that some motors are always on, some are seldom on and some are turned on and off frequently. The motors are typically turned on with the compressors unloaded and run with the compressor loaded, after a time delay. When pressure in the tank is too high the compressors are shut down by first unloading the compressor and then shutting down the compressor. However there is typically a long delay between unloading the compressor and shutting down the motor for the compressor such that the motor is protected from having to quickly start up again if the pressure drops in the tank and more pressure is called for. These long turn off delays can result in two or more compressors being in an unloaded mode at the same time which wastes energy, because unloaded, the motor draws nearly 40% of its full load current.

When a factory opens weekly or each morning and the air tanks must be pressurized for the needs, fill demand for the compressors is typical and all the compressors will come on in a typical system if started in an auto mode. However, most operators start them manually to prevent this because it results in extra cycling of the compressors. Similarly during the day there are peak times when all compressors are needed and other times of the day, such as during work breaks, lunch or between shifts less demand for compressed air allows for some compressors to shut down. Nights, weekends, holidays and at other scheduled times the demand may be very low to non-existent.

In order to manage the compressors to run in the most efficient manner to save energy and to lower wear on the motors and compressors and cut maintenance costs a controller 10 is used to maximize the efficiency of the system.

In the present system from an initial low pressure start the controller will limit the number of compressors on by considering the rate of change of the head. If the rate of increase is too low a second compressor is turned on and if it is needed then loaded, then a third etc until the desired rate of change is reached. The rate at which the compressors are turned on can be higher or lower to meet the demand for air pressure. The delays between stages of shedding loads and shedding motors can shrink, expand or cancel dynamically depending on the the rate of change of the head to meet the demand for air pressure. The controller limits the number of compressors unloaded at any one time to one except in temporary cases of extreme fluctuations in demand. The controller rotates the order of use of the compressors to approximately even the run time on each compressor and also rotates compressors when a compressor is turned on and off in excess of a programmed number of motor cycles per hour.

As shown in FIG. 1 controller 10 turns on and off motors 21–26 connected to compressors 31–36 thus controlling the number of compressors providing compressed air to tank 50. In the embodiment described here the motors 21–26 are constant speed motors of equal size. This example is used for simplicity of explaining the invention. Any mix of motor sizes and compressor sizes can be used. Further, variable speed motors can be used in other embodiments of the invention where the controller not only controls which motors to turn on but what speed as well. Similarly, other types of compressors may have variable pitch blades or modulation by pass valves and controls thereof on the controller. In these cases a controller or computer can use one or more of these variables to fine modulate the load in lieu of the load/unload method.

The controller, in the embodiment shown in FIG. 1, controls valves 41–46 controlling the loading on the compressors 31–36 during start. The method is to start each compressor 31–36 in an unloaded mode, which produces an output on the order of 15–20% of a full load, on most compressors, and then go to a full load before starting the next compressor. This method, prevents surging of the pressure in tank 50 and provides for incremental increases in pressure in the tank. On shut down the compressors are first unloaded and then the motors are shut off. The controller only allows one compressor to run unloaded at any given time for efficiency of operation of the system, except in rare occasions of unusual extreme variations in loading where two compressors may be temporarily unloaded simultaneously.

In the embodiment presented all the motors and compressors are the same size and kind. The controller 10 is programmed to run motors 21–26 and compressors 31–36 in the most economical and efficient method to save electricity and wear and tear on the motors and compressors.

The controller is programmed to rotate the order of the motors 21–26 lead and lag positions to approximately even the wear on all the motors 21–26 and compressors 31–36.

Tank 50 receives the compressed air from each of the compressors 31–36 and distributes the compressed air to the pneumatic equipment 60–68 around the building.

Pressure sensor 55 in tank 50 provides the controller 10 with information about the pressure in the tank 50. With the pressure information the controller 10 can calculate rates of change of pressure in the tank 50, and integrate dynamically with direction and amount of offset to control the motors 21–26 and load valves 41–46 accordingly to provide an efficient use of the motors 21–26 and compressors 31–36 to save energy and reduce maintenance costs while increasing the life of the motors 21–26 and compressors 31–36.

In one embodiment the controller 10 can be programmed to know when demand will begin so it can start up the system and have a head ready for the expected load. Different set points for the head may be programmed for various times and varying plant pressure requirements.

Figure 2A:
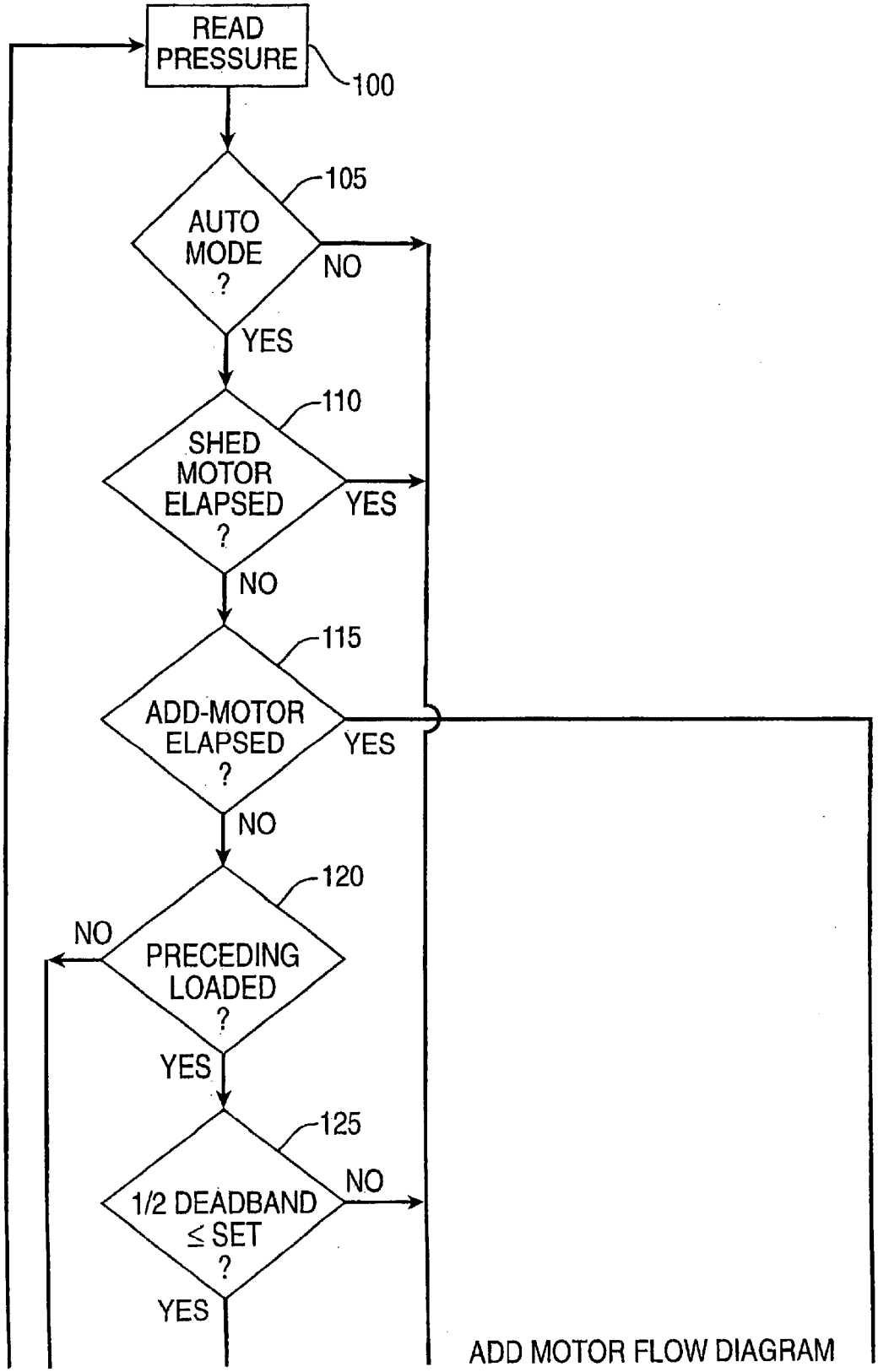
FIG. 2A is a flow chart of the algorithms used to add a motor to the system to increase the pressure in the tank.
Figure 2B:
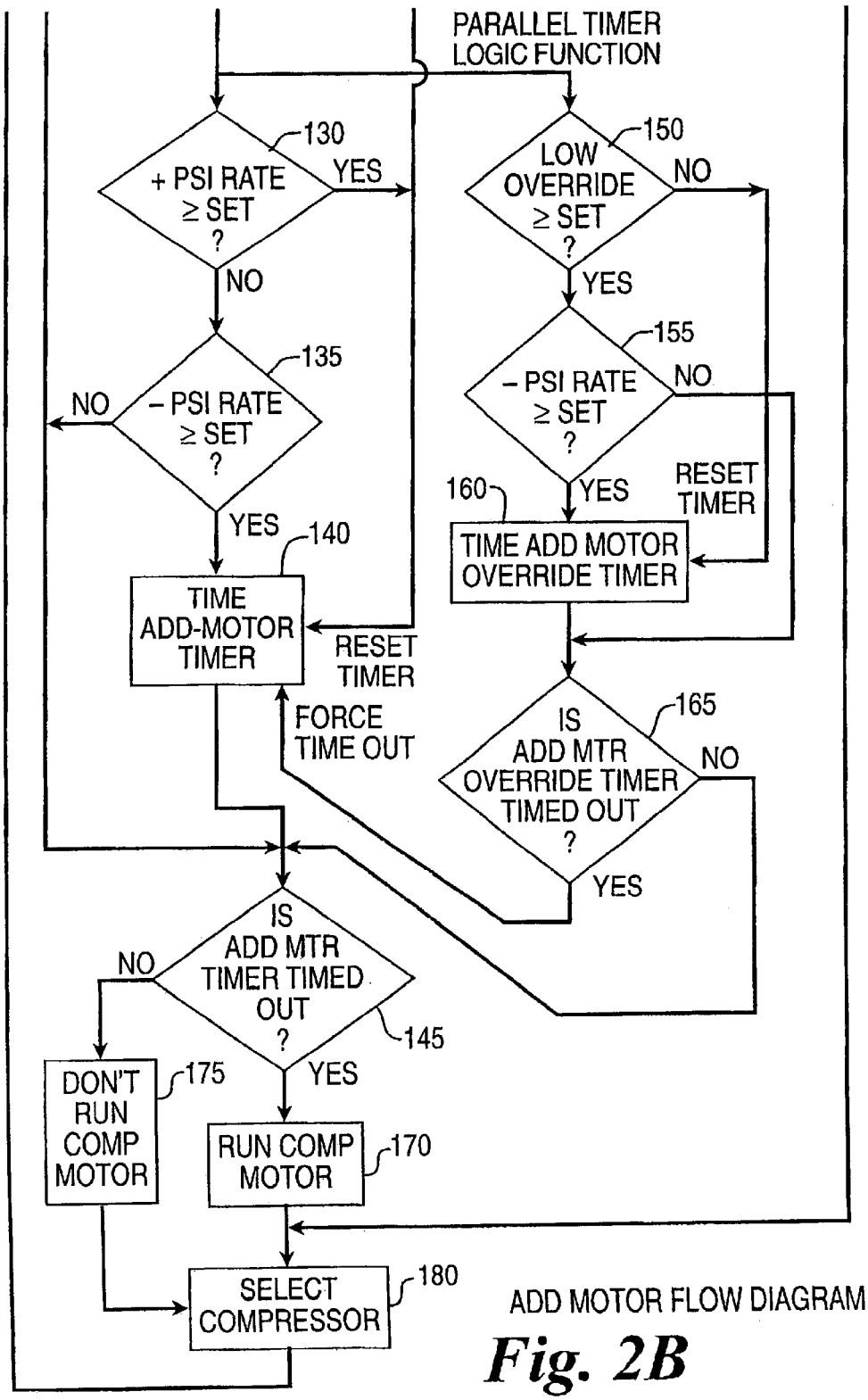
FIG. 2B is a flow chart of the algorithms used to add a motor to the system to increase the pressure in the tank.

FIG. 2 shows an algorithm used by the controller 10 to add a motor to the system. If the tank 50 pressure is lower than the set point, and the rate of change of the pressure is not recovering quickly, the controller 10 turns on one of the motors 21–26 thereby running one of the compressors 31–36. The controller 10 may be programmed to know some initial conditions such as time of day, and the day of the week, to change the set points if they are able to lower the system pressure at certain times such as nights or weekends.

The controller 10 rotates the compressors so that the lead compressors change periodically and if the last lag compressor in use cycles on and off too many times in a given time period the controller rotates the lead compressor to prevent too many start ups on one compressor. The controller preferably uses an end around system for picking lead compressors such that the first time the order of turning on the compressors is 1, 2, 3, 4, 5, 6, the second time 2, 3, 4, 5, 6, 1 etc.

Figure 6:
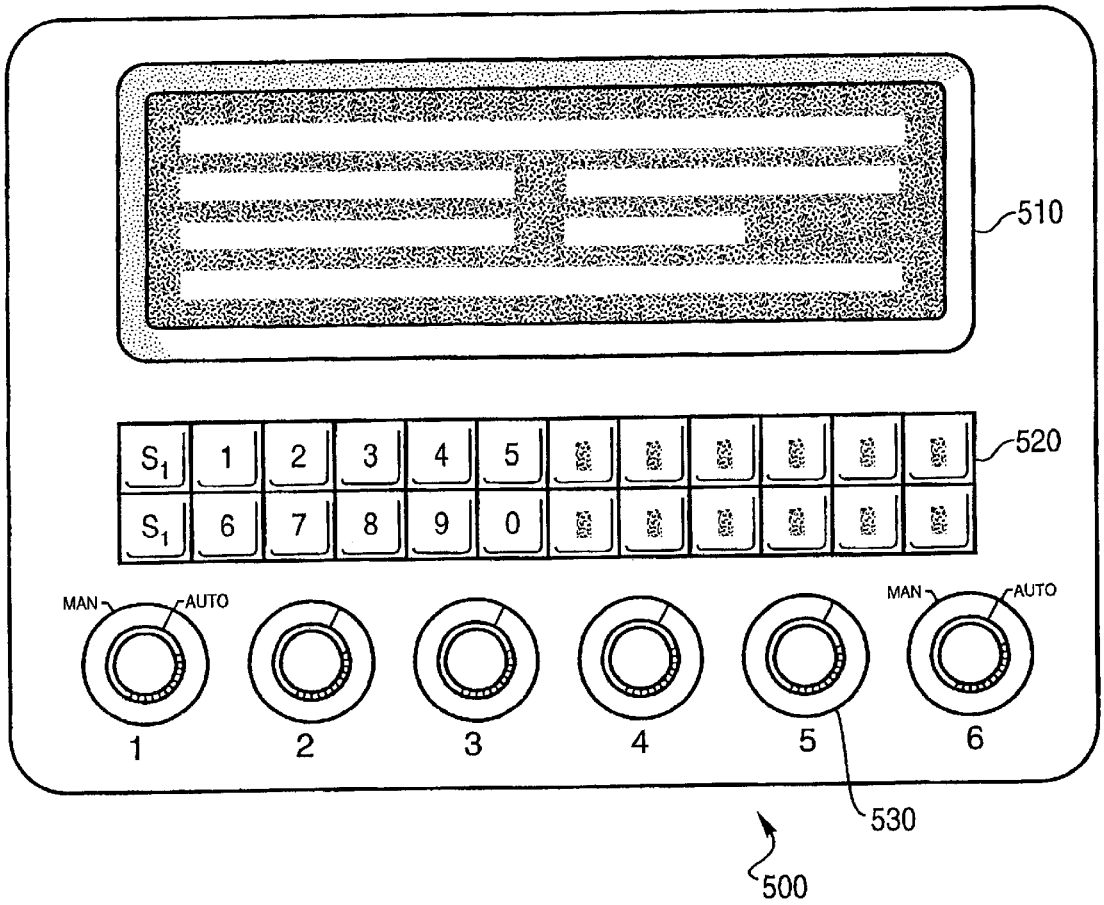
FIG. 6 is a front view of a control panel.

Pressure measurements 100 are obtained in the tank 50 by sensors 55. The controller 10 in step 105 then looks to see if the compressor 31–36 has been set to automatic mode or to manual mode by knobs 530 on the control panel 500 in FIG. 6. If the compressor 31–36 is in manual mode the timer in step 140 is constantly being reset to zero on every loop trough the system on the order of every 18 milliseconds, such that the time on the add motor timer will never time out in step 145. The compressor is therefore off in step 175 as far as the controller is concerned. However the compressor may be on as the manual controls dictate. The controller then looks at which motor to select in step 180. If the manual controls 530 on the control panel 500 in FIG. 6 are set to manual, and the manual controls are set to turn the compressor on, pressure is being added to tank 50, but the logic of the controller 10 does not control that compressor. The balance of the compressors function under the control of the controller 10. The controller 10 keeps track of the amount of time each motor is on, even if it is in manual mode. The controller then goes to this compressor's load and logic of FIG. 3 for this compressor.

If the next compressor 31–36 is set to automatic mode in step 105 then the controller 10 tests, in step 110, to see if the shed motor timer for this compressor has timed out. If the shed motor timer has timed out it indicates the motor is to shut down. The controller resets the add motor timer in step 140 to zero such that the add motor timer in step 145 is not timed out, and the compressor motor is off.

The controller 10 proceeds to step 115 to determine if the motor is on. If the motor is on the controller 10 then goes to step 180, and the controller selects a motor 21–26 to keep on compressor 31–36.

Figure 3A:
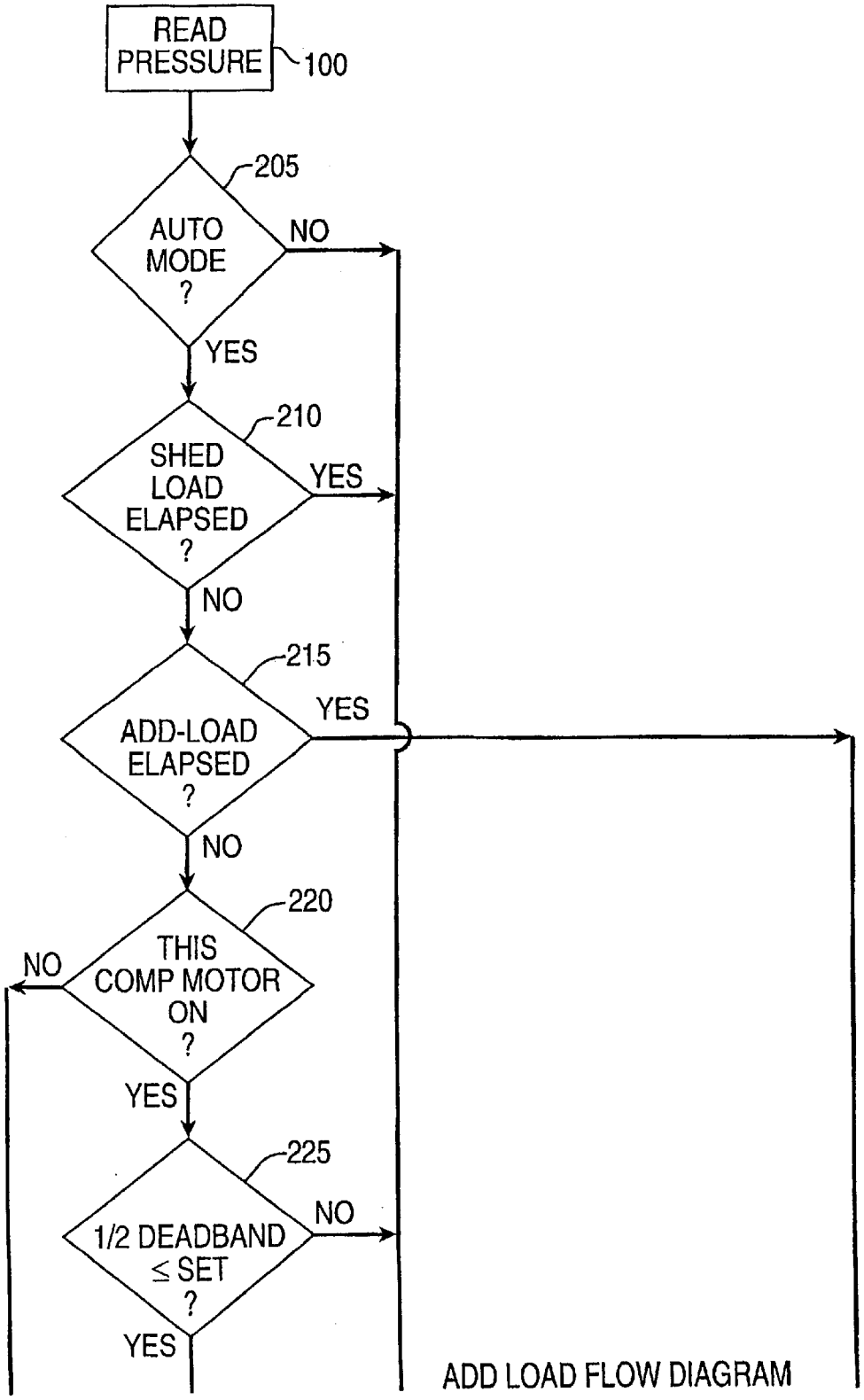
FIG. 3A is a flow chart of the algorithms used to add a load on a compressor to increase the pressure in the tank.
Figure 3B:
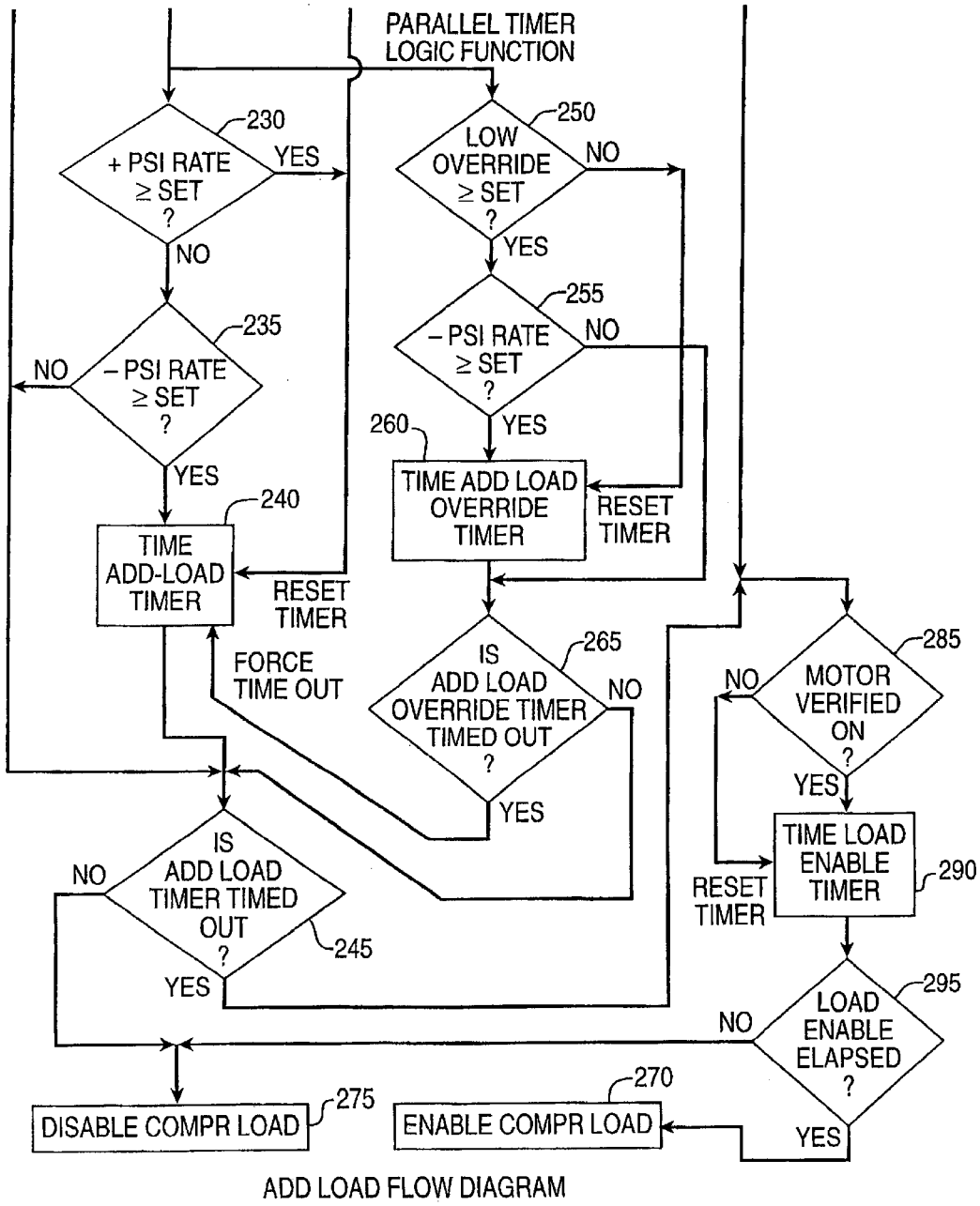
FIG. 3B is a flow chart of the algorithms used to add a load on a compressor to increase the pressure in the tank.

If the motor is not on in step 115 then the controller 10 moves to step 120 to see if the preceding compressor has been loaded. If the previous compressor is not loaded then the controller goes to step 145 bypassing the add motor timer such that the timer is not started or kept running. It is therefore not timed out in step 145 and the compressor is not run in step 175. The controller will run through the add load flow chart (FIG. 3).

If the preceding compressor started is loaded, then the controller moves to step 125 to see if the pressure in the tank 50 is lower than the set point by at least ½ of the dead band setting or more. If the pressure in tank 50 has not dropped by at least ½ the dead band pressure then the controller moves on to step 140 where the time on the add motor timer is reset to its starting value. Since the controller runs through the flow chart in the figures on the order of 50 times a second the add motor timer will be constantly reset to it's starting value as long as the pressure is above the programmed pressure in step 125.

If the pressure in tank 50 has dropped by at least ½ the pressure set as the dead band pressure in step 125 then the controller moves to steps 130 and 150. The controller goes to step 130 to see if the rate of change of the pressure in the tank 50 is at a rate toward the set point. If the rate of change toward the set point is greater than or equal to the programmed value then no further air pressure is added to the tank. Therefore, the controller moves to step 140 to reset the timer for turning on the motor to it's starting value.

If the rate of pressure increase for the pressure setting is not high enough in step 130 then the controller goes to step 135 to see if the rate of pressure in tank 50 is declining from the programmed set point. If it is declining at a rate less than its set point it will "hold" the timing. If the rate is declining at a rate equal to or greater than the set point, the controller 10 then goes to step 140 to count down time on the add motor timer. The controller then goes to step 145 to see if the add motor timer has timed out. If the add motor timer has timed out, the motor for a compressor is started and the compressor comes on line to add pressure to tank 50. If the timer for adding a motor in step 145 has not timed out then no compressor motor is started in step 175.

If the rate of pressure decline from the set point in step 135 is not equal to or greater than the programmed value then no time is counted down from the timer in this loop, the timer will not have timed out in step 145 and the motor will not have started.

If the pressure in step 125 has dropped below ½ the dead band pressure and is lower than the set point, then a parallel timer is checked to see if the compressor should be started sooner than in the step 130 flow. The controller will process step 130 and step 150. In step 150 a psi reading from step 100 is compared to a programmed pressure. If the pressure is above the programmed pressure in step 150 then the add motor timer in step 160 is reset to it's starting value. If the pressure in step 150 is below or equal to the programmed pressure the controller goes to step 155. If the rate of pressure change is showing a pressure drop of more than a programmed rate, then the add motor override timer in step 160 is allowed to count down. If the condition persists for the length of time set on the timer in step 160 the timer will time out. Step 165 asks if the timer in step 160 has timed out indicating that the compressor motor must be started. If the timer has timed out in step 165 the timer in step 140 is forced to time out. The controller 10 notes the add motor timer has timed out in step 145 and instructs a compressor motor to turn on in step 170.

If the rate of pressure reduction is not equal to or exceeding the programmed rate in step 155 then the pressure is not declining fast enough to count down time on the motor override timer in step 160 such that the timer will not be timed out in step 165 and the controller will check if the add motor timer has timed out in step 145 and the compressor is not started by the 160 timer.

FIG. 3 shows a flow chart used by the controller 10 to add a load to the compressor. If the tank 50 pressure is lower than the set point, and the rate of change of the pressure is not recovering quickly enough, the controller 10 turns on the loading valve 41–46 thereby adding a load on that compressor 31–36. The pressure may be low and dropping at a rate such that the load will be added though steps 230 on, after a long delay, or the pressure may be very low and dropping at a rate such that the load is added after a short delay through steps 250 on. When the add load logic decides to add a load the load is only added if the motor for this compressor is verified on as shown in steps 285 on. This is verified by a feedback contact from the compressor's motor circuit.

Pressure measurements 100 are obtained in the tank 50 by sensors 55. The controller 10 in step 205 then looks to see if the compressor 31–36 has been set to automatic mode or to manual mode by knobs 530 on the control panel 500. If the compressor 31–36 is in manual mode the timer in step 240 is constantly being reset to zero, such that the time on the add load timer will never time out in step 245. This effectively shuts off the selected load on the compressor 31–36 from the system by controller 10 in step 275. The controller 10 considers the load as unloaded. If the controls are set to manual, then pressure is created in the tank 50, but the logic of the controller 10 does not control that compressor. The balance of the compressors function as before under the control of the controller. The controller keeps track of the amount of time each motor is on and if it is in the loaded or unloaded configuration.

If the compressor is set to automatic mode in step 205 then the controller 10 tests, in step 210, to see if the load on this compressor has been or should be unloaded by the controller 10. If the shed load timer has timed out then the time in the add load timer, in step 240, is reset to it's starting value.

If the shed load timer has not timed out in step 210 the valve has not unloaded the compressor and the controller proceeds to step 215 to determine if the add load timer has timed out. If the add load timer has timed out the controller then goes to step 285 to see if the motor is on. If the motor is on, time is added to the load enable timer in step 290, if the motor is not on in step 285 then the load enable timer in step 290 is reset to it's starting value. When the load enable timer in step 290 times out, then in step 295 the load is added to the compressor in step 270. If the load enable timer elapsed decision is "no", in step 295, the compressor load is disabled and the compressor remains unloaded in step 275.

If the add motor timer elapsed decision in step 215 is "no", then the controller 10 moves to step 220 to see if this motor is on. If the motor is not on there is no point adding a load to the compressor so the controller goes to step 245 bypassing counting down time on the add load timer in step 240. Therefore the add load timer in step 245 will not have timed out and the controller will disable the compressor load in step 275.

If the compressor motor in step 220 is on then the controller moves to step 225 to see if the pressure in the tank 50 is lower than the set point by at least ½ of the dead band setting or more. If the pressure in tank 50 has not dropped by at least ½ the dead band pressure then the controller moves on to step 240 where the timer to add the load is reset to it's starting value.

If the pressure in tank 50 has dropped by at least ½ the pressure set as the dead band pressure in step 225 then the controller moves to step 230 to see if the rate of change of the pressure in the tank 50 is at a rate toward the set point setting greater than or equal to an amount programmed into the controller. If the rate of change toward the set point is greater than the programmed value then the pressure is going up at a sufficient rate such that no further air pressure needs to be added to the tank and the controller moves to step 240 to reset the timer, for adding a load, to it's starting value.

If the rate of pressure increase is not high enough in step 230 then the controller goes to step 235 to see if the rate of pressure in tank 50 is declining from the programmed set point. If the rate is declining at a rate equal to or greater than that programmed, then the controller 10 goes to step 240 to count down time on the add motor timer. The controller then goes to step 245 to see if the add load timer has timed out in step 240. If the add load timer has timed out in step 240 the load for a compressor is added in step 270 because the motor is on in step 285, and the load enable timer has been on in step 290, and has timed out in step 295, and the compressor adds more pressure to tank 50. If the timer for adding a load in step 245 has not timed out, then no load is added to a compressor in step 275 and the next pressure reading is taken at step 100.

If the rate of pressure drop in step 235 is not greater than the programmed rate then no time is counted down from the add load timer in step 240 the timer will not be timed out in step 245 and the load is not on the compressor in step 275.

If the pressure in step 225 has dropped below ½ the dead band pressure and is lower then the set point then a parallel timer is checked to see if the load should be started sooner. The controller 10 will process step 230 and 250. In step 250 a psi reading from step 100 is compared to a programmed pressure. If the pressure is not below the programmed pressure in step 250 then an add load override to the timer in step 240 is not considered, the time for the add load override timer in step 260 is reset to it's starting value. If the pressure in step 250 is below the programmed pressure the controller goes to step 255. If the rate of pressure change is showing a pressure drop of more than a programmed rate then time is counted down on the add load override timer in step 260. If the condition persists for the length of time set on the timer in step 260 the timer will time out in step 265 indicating that the compressor load must be turned on. This is done by the timer in step 240 being forced to time out. The controller 10 notes the add load timer has timed out in step 245 and instructs a valve to add the load to the compressor in step 270.

If the pressure for the add load low pressure offset override in step 250 has not dropped to the programmed pressure needed to start the add load override timer then the time for the add load override timer 260 is reset to it's starting value.

If the pressure dropped below the add load low override offset pressure in step 250 the controller goes to step 255. If the rate of pressure reduction is not exceeding the set point in step 255 the time in step 260 is not counted down and is on "hold" at its present value and the controller bypasses the count down of the time on the add load override timer such that the timer will not be timed out in step 265 and the controller will ask if the timer for the add load timer has timed out in step 245.

If the add load timer status in step 245 is yes the controller goes to step 285 to see if the motor run verify feedback is on to check if the motor is verified running. If the motor is verified on, time is counted down on the load enable timer in step 290, if the motor is not verified on in step 285 then the load enable timer in step 290 is reset to it's starting value. When the load enable timer in step 290 shows a timed out status in step 295 the load is added to the compressor in step 270. If the load enable timer does not show a timed out status in step 295 the compressor load is disabled and the compressor remains unloaded in step 275.

Figure 4A:
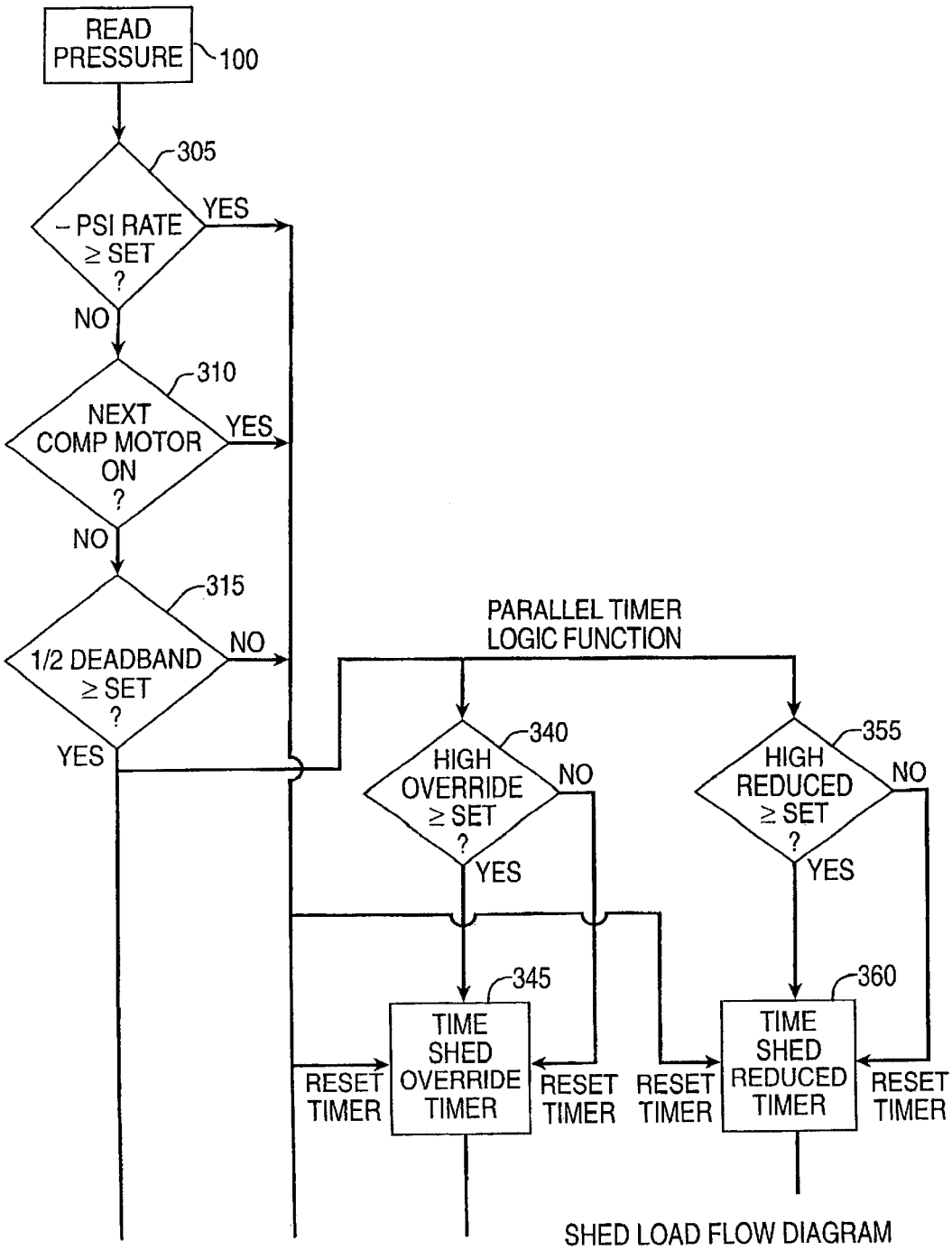
FIG. 4A is a flow chart of the algorithms used to shed a load to the system to decrease the pressure in the tank.
Figure 4B:
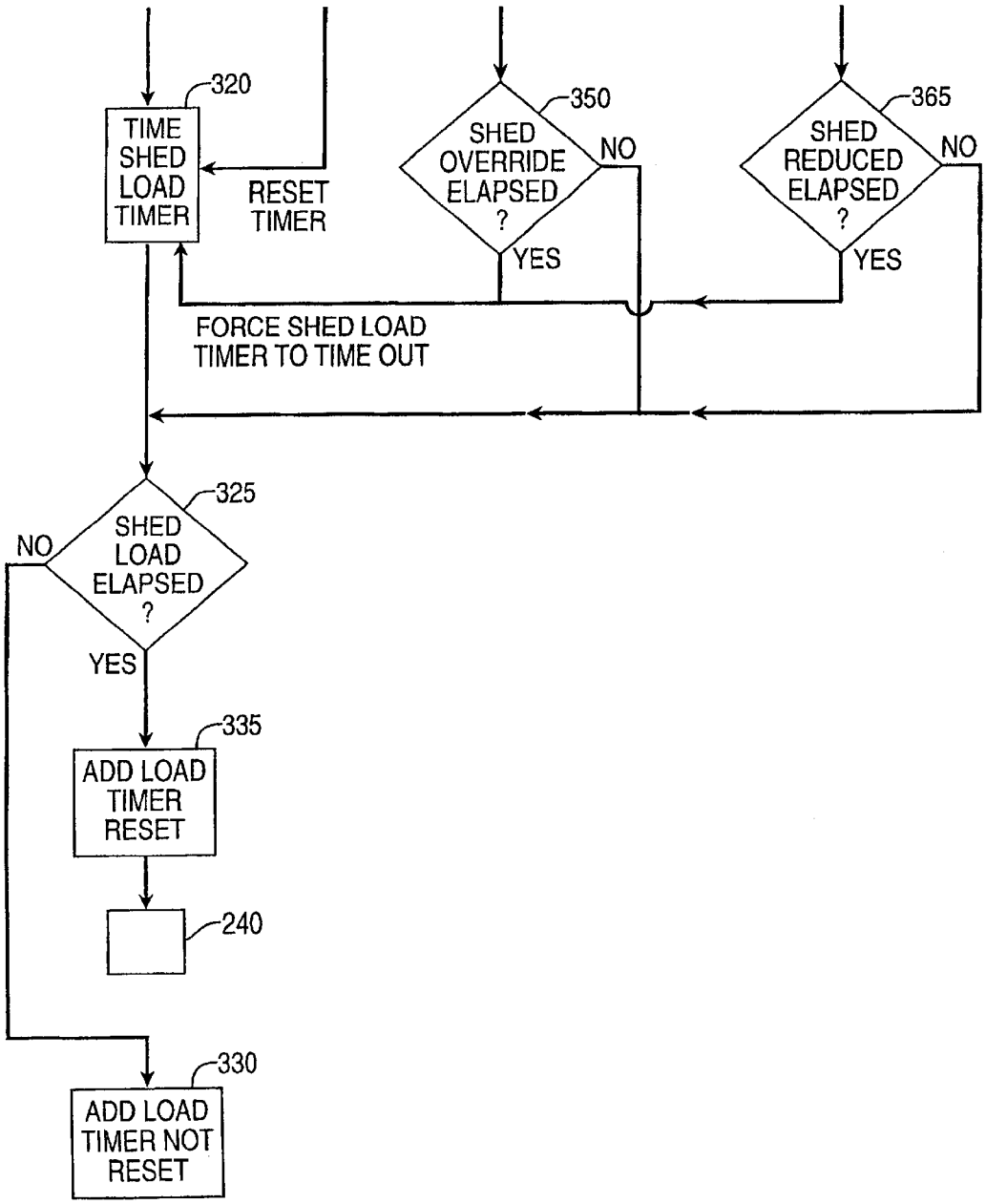
FIG. 4B is a flow chart of the algorithms used to shed a load to the system to decrease the pressure in the tank.
Figure 5A:
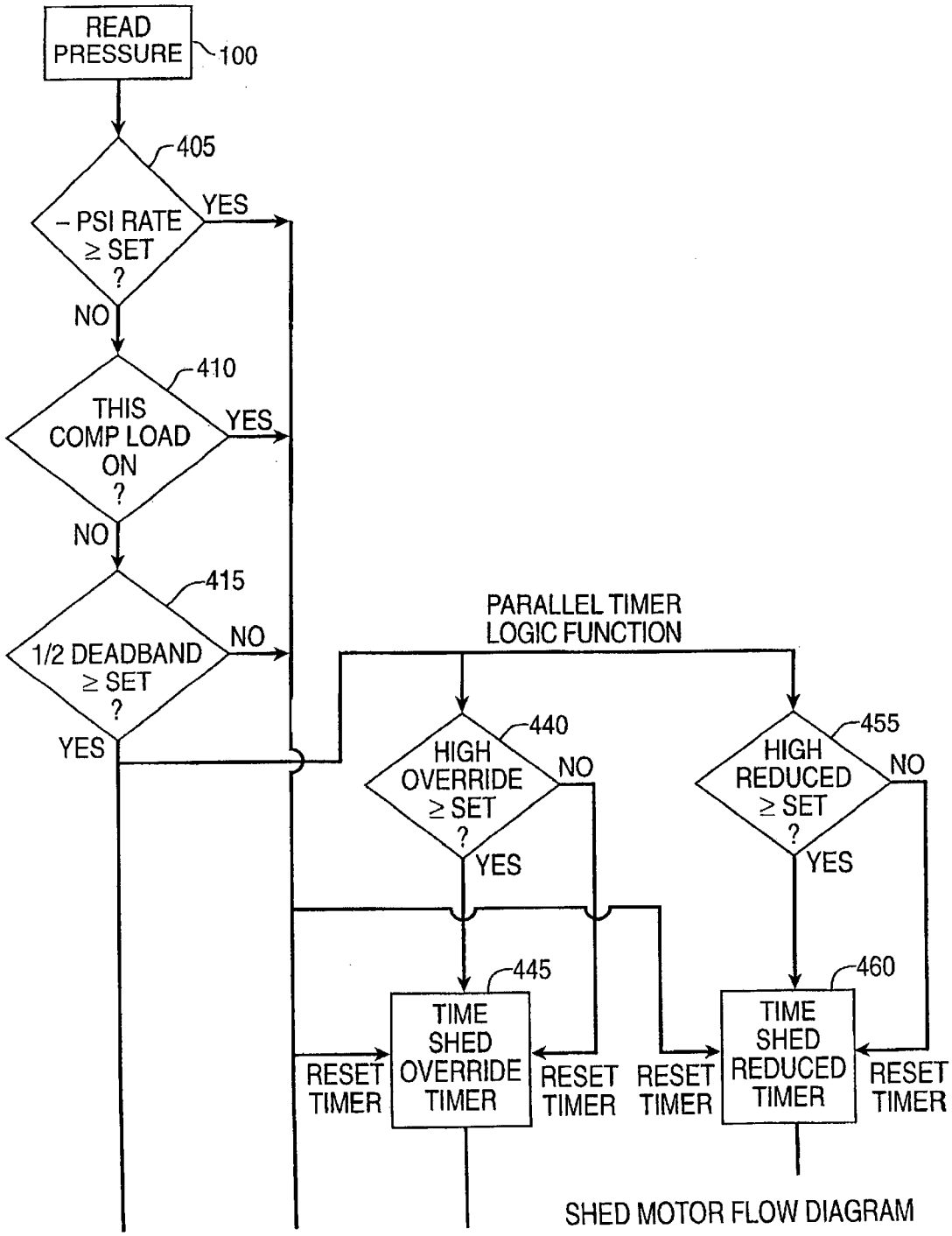
FIG. 5A is a flow chart of the algorithms used to shed a motor on a compressor to decrease the pressure in the tank.
Figure 5B:
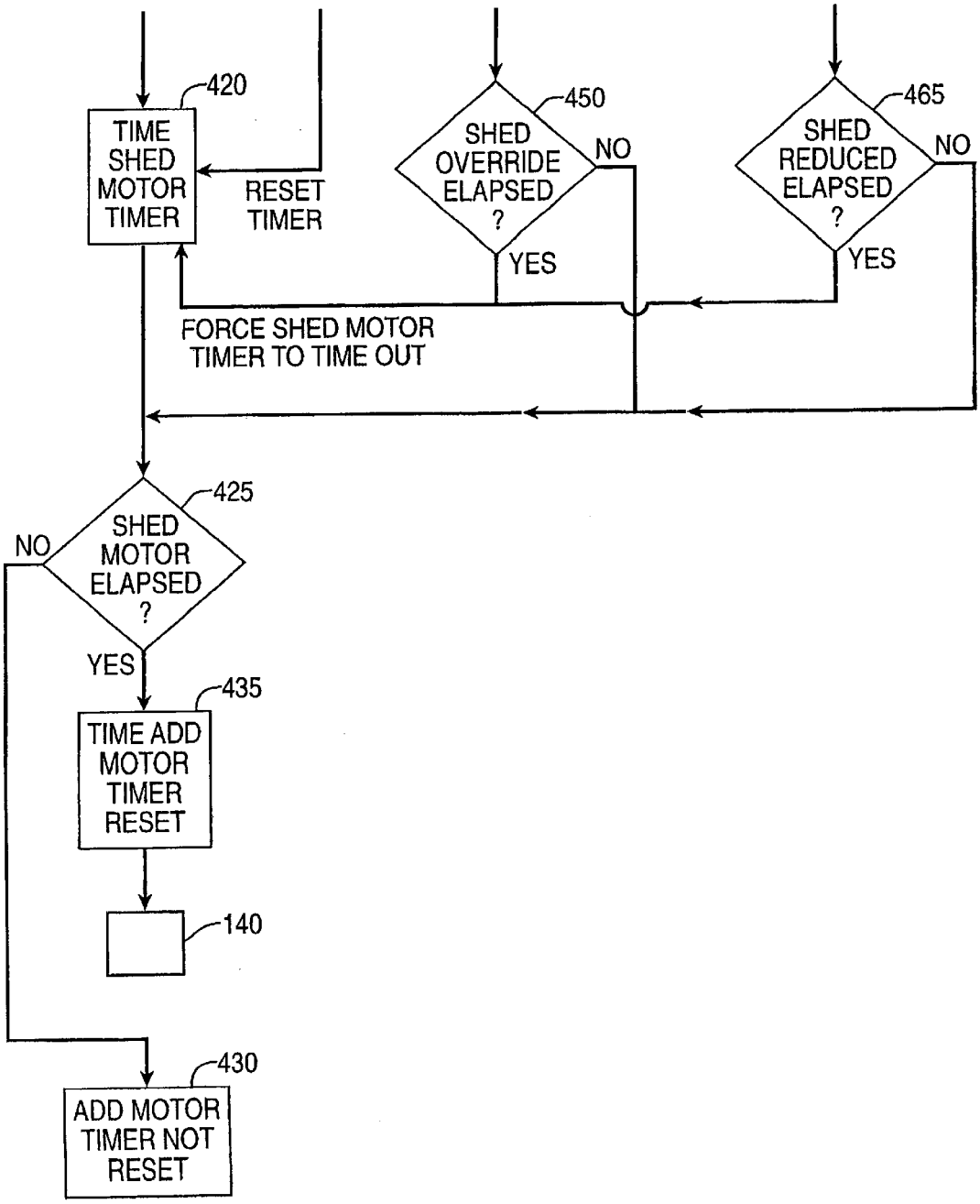
FIG. 5B is a flow chart of the algorithms used to shed a motor on a compressor to decrease the pressure in the tank.

FIG. 4 shows the shed load flow diagram. When the pressure in tank 50 gets too high one of the compressors 31–36 may be shut down. For each compressor the load is first turned off and if the pressure in the tank is still too high the compressor motor is turned off as shown in FIG. 5. The add motor and add load flow diagrams in FIGS. 2 and 3 show one override option if the pressure drop and the rate of pressure drop are too much, to turn the pressure up quicker. In FIGS. 4 and 5 there are two options for dropping the pressure if it gets too high one option acting more quickly than the other to prevent the pressure from building up too much. For the shed load steps in FIG. 4 the controller 10 starts with a pressure reading in step 100 to measure the pressure in tank 50. The controller 10 calculates the rate of change of the pressure in tank 50 to see if the pressure is dropping at a rate greater than the rate programmed into the controller 10. If the pressure is dropping at a fast enough rate then the controller 10 goes to step 320 and resets the time to it's starting value on the shed load timer since the pressure is dropping by itself and there is not a current need to unload a compressor.

If the pressure rate change is not dropping at the set point rate or more, then the controller goes to step 310 to see if the next compressor motor is engaged prior to this compressor logic decision. If the next compressor motor is running the controller goes to step 320, 345 and 360 and resets the time to the start values on the shed load timers.

If the next compressor motor is found to be shut down in step 310 then the controller 10 goes to step 315 to see if the pressure in tank 50 is higher than the set point plus ½ the dead band pressure. If the pressure in tank 50 is not higher than ½ the dead band above the set point then the time on the shed load timers 320, 345 and 360 are reset to their starting values since the pressure is close to the set point and the load does not have to be shed at this time.

If the pressure in tank 50 is higher than the set point by ½ the dead band or more in step 315 then the controller 10 goes to step 320, 340 and 355 to see if the load should be unloaded after a normal wait in steps 320 on, or should be unloaded sooner in steps 340 on, or should be unloaded quickly in steps 355 on.

If the decision step 315 is yes the controller then goes to step 320 to let the timer run. The controller then goes to step 325 to see if the shed motor timer has timed out indicating that the rate of pressure change was dropping at lower than the programmed rate (step 305), the next compressor motor is off (step 310) and the pressure was equal to or higher than ½ the dead band for the length of time the timer was set for (step 320). If the timer times out as monitored by step 325, the controller goes to step 335 which resets the add load timer of step 240 in FIG. 3. With the add load timer in step 240 reset it is not timed out in step 245 so that the compressor load is disabled in step 275.

For situations where the pressure in the tank 50 has increased and the load on the compressor needs to be shed faster than the shed load timer in step 320 would allow, step 315 also goes to the parallel shed load high override offset 340 to shed the load on the compressor faster. If the pressure is higher than the programmed setting in step 340 the controller counts down the time on the shed load override timer 345. When the timer times out in step 350 it forces the time shed load timer in 320 to time out resetting the add load timer in 335 which resets the add load timer in step 240 such that the add load timer is not timed out leading to the disabling of the compressor load in step 275.

If the pressure in tank 50 does not reach the high override offset pressure in step 340 then the time is reset to it's starting value for the shed load override timer 345 such that the timer never times out in step 350 and the controller goes to the shed load timer timed out step 325 to see if the shed load timer 320 has timed out.

The time shed load override timer in step 345 can be reset to it's starting value from the three conditions in steps 305, 310 and 315 if the pressure rate drop is above the set point in step 305, if the motor of the next compressor motor is still running or if the pressure is within the dead band from the set point in step 315.

For situations with very high pressures in tank 50 such as at the end of the day when demand for air pressure is dropping fast, the controller 10 has a shed load high reduced offset 355 to shed a load even faster than in the case of the shed load high override offset in step 340. The time shed load reduced timer in step 360 will time out faster than the time shed load override timer in step 345. If the pressure in step 315 is above the set point by ½ the dead band or more then the controller checks to see if the pressure is very high in step 355. If it is above the set point by the programmed amount in step 355 the controller goes to step 360. If the pressure stays above the set point for the programmed time the shed load reduced timer times out in step 360, the timed out condition is detected in step 365, forcing the shed load timer in step 320 to time out which is detected in step 325 which then sheds the load as described above by steps 335, 240, 245 and 275.

As with the time shed load override timer in step 345 the shed load reduced timer in step 360 will be reset to it's starting value under the three conditions of steps 305, 310 and 315, if the pressure rate drop is above the set point in step 305, if the motor of the next compressor is still running in step 310 or if the pressure is within the deadband from the set point in step 315.

If the shed load reduced timer decision in step 365 is a no indicating that timer 360 has not timed out then as with the shed load override timer decision in 350 no action is taken and the controller looks to see if the shed load timer in step 320 has timed out in step 325. If it has not timed out then in step 330 the load is not removed from the compressor.

FIG. 5 shows the shed motor flow diagram. When the pressure in tank 50 gets too high one or more of the compressors 31–36 may be shut down. As with the unloading of the compressor in steps 340 and 355 there are high pressure overrides in steps 440 and 455 to quickly shed the motors if the pressure in the tank 50 gets too high.

For the shed motor steps the controller 10 starts with a pressure reading in step 100 to measure the pressure in tank 50. The controller 10 in step 405 calculates the rate of change of the pressure in tank 50 to see if the pressure is dropping at a rate greater than the rate programmed. If the pressure is dropping at a fast enough rate, then the controller 10 goes to step 420, resets the time on the shed motor timer to it's starting value and no action needs to be taken at this time, as shown by the shed timer not timing out in step 425 and the add motor timer is not reset in step 430 so no action is taken.

If the pressure rate change in step 405 is not dropping at the rate of the set point or more then the controller goes to step 410 to see if the compressor load is engaged on this compressor. If the load is on, then the controller goes to step 420 and resets the time to it's starting value on the shed motor timer. The shed motor timer will then not be timed out in step 425 leading to the step 430 where the add motor timer is not reset in step 140 so it can time out in step 145 and run the motor in step 170 so the motor is not shut down.

If the load is found to be off in step 410 then the controller 10 goes to step 415 to see if the pressure in tank 50 is higher than the set point by ½ the dead band pressure. If the pressure in tank 50 is not higher than ½ the dead band above the set point then the time on the shed point timer is reset to it's starting value in step 420, the shed motor timer does not time out and the compressor motor will not have to be shut down at this time.

If the pressure in tank 50 is higher than the set point by ½ the dead band or more in step 415 then the controller goes to step 420 to count down the time on the timer. The controller then goes to step 425 to see if the shed motor timer has timed out, indicating that the rate of pressure drop was lower than the programmed rate, the compressor load is off, and the pressure was higher than ½ the dead band. If the timer is shown to have timed out in step 425 the controller goes to step 435 which resets the add motor timer of step 140 in FIG. 2. With the add load timer in step 140 reset it is timed out in step 145 so that the compressor motor is turned off in step 175.

For situations where the pressure in tank 50 is to increasing very quickly and the compressor needs to be shed faster than the shed motor timer in step 420 would allow the parallel shed motor high override offset 440 will stop the motor on the compressor faster if the pressure builds up to a predetermined pressure over the set point.

If the high override pressure is reached in step 440 and stays at the pressure until the time shed motor override timer in step 445 times out it will force the shed motor timer in step 420 to time out. The controller in step 425 notes that the timer has timed out and goes to step 435 which resets the add motor timer in step 140 (FIG. 2) such that the add motor timer in step 145 does not time out leading to shedding the compressor motor in step 175.

If the high override offset pressure in tank 50 is not reached in step 440 then the time is reset to it's starting value in the high override timer 445 such that the timer never times out in step 450 and the controller goes to the shed motor timer timed out decision of step 425 to see if the shed motor timer has timed out. If not then the controller goes to step 430 and no change is made on the time add motor timer in step 140 so the motor will stay on.

The time shed motor override timer in step 445 can be reset to it's starting value from the three conditions in steps 405, 410 and 415 if the pressure rate drop is above the set point in step 405, if the load of the compressor is still on or if the pressure is within the dead band from the set point.

For situations with very high pressures in tank 50 such as at the end of the day when demand for air pressure is dropping fast, the controller has a shed motor high reduced offset 455 to shed a motor even faster than in the case of the shed motor high override offset in step 440. In step 455 the pressure has gone up even more, than in step 440. The time shed motor reduced timer in step 460 will time out faster than the time shed motor override timer in step 445. If the pressure in step 415 is above the set point by ½ the dead band or more, then the controller checks to see if the pressure is very high in step 455. If it is above the set point by the programmed amount the controller goes to step 460. If the pressure stays above the set point by the programmed time the shed motor reduced timer times out in step 465 forcing the shed motor timer in step 420 to time out monitored by step 425 which then sheds the motor as described above by steps 435, 140, 145 and 175.

As with the time shed motor override timer in step 445 the shed motor reduced timer in step 460 will be reset to zero under the three conditions of steps 405, 410 and 415, if the pressure rate drop is above the set point, if the load of the compressor is still on or if the pressure is within the dead band from the set point.

If the shed motor reduced timer decision in step 465 has not timed out, then, as with the shed motor override timer decision in 450 no action is taken and the controller looks to see if the shed motor timer in step 420 has timed out in step 425. If it has not timed out in step 430 the compressor is not turned off.

Figure 7:
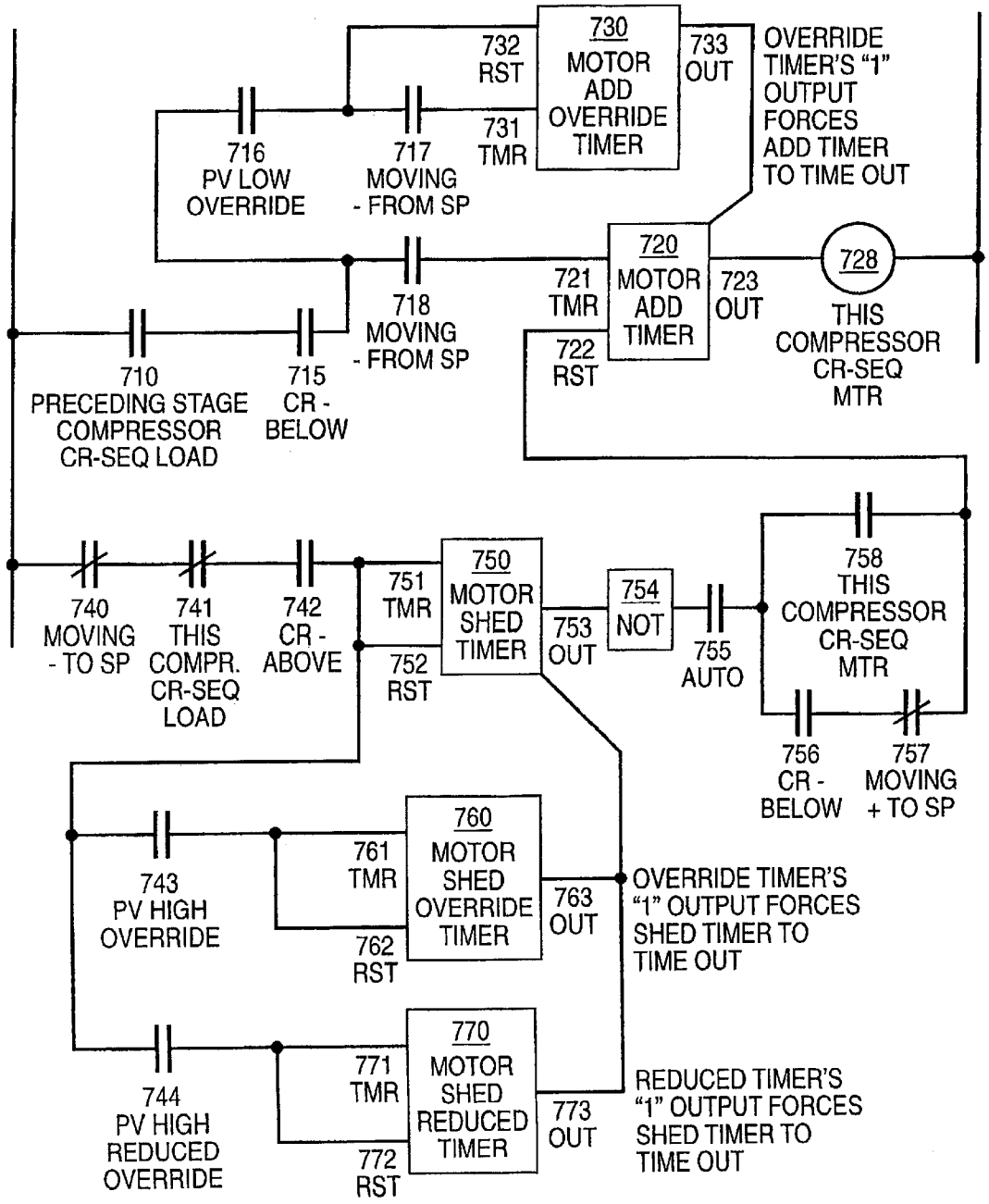
FIG. 7 is a logic diagram of the motor add and shed software.
Figure 8:
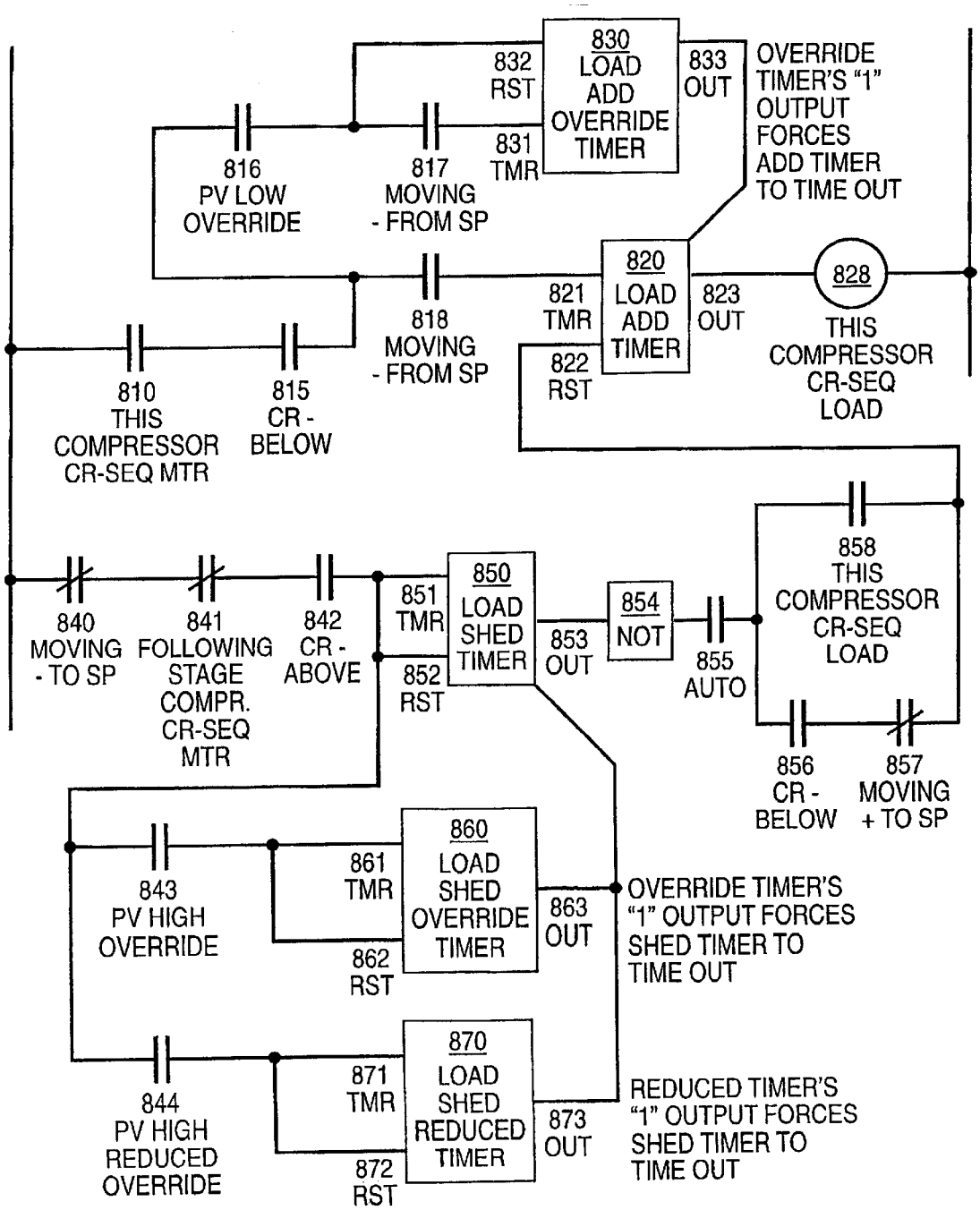
FIG. 8 is a logic diagram of the load add and shed software.

The following is the add/shed logic description using software relay ladder logic (FIGS. 7 and 8). In FIG. 7 the logic of the add and shed motor timers is shown. A circuit like this is assigned to every compressor. When the air pressure in tank 50 falls to a value less than the set point psi by more than ½ the deadband then the cr-below relay 715 is activated, placing it in a logic 1 condition. If the pressure in tank 50 is dropping from the set point by programmed rate or more in moving negatively from SP, relay 718 is activated and if the preceding compressor in the series has its load on, activating preceding stage compressor cr-seq load relay 710, then the add motor timer 720 can be started by a logic 1 input at timer input 721. The motor add timer 720 will time when the time input 721 is a logic 1 and the time reset 722 is a logic 1.

When the time input 721 and the time reset 722 are both kept at a logic 1 for the time set on the motor add timer 720, it times out, setting the out state 723 to a logic 1. The compressor motor is then turned on by cr-seq mtr 728. If the time reset input 722 does not remain at a logic 1 then the add motor timer 720 is reset to it's starting value.

If the pressure in tank 50 falls to a lower level, then the motor for the compressor may have to be started sooner. Therefore a pressure variation (pv) low override relay 716, set at a lower pressure than cr-below relay 715, will be released when the lower pressure is reached. If the pressure is dropping from the set point at a programmed rate or more in moving negatively from SP relay 717 then both the timer input 731 and the reset input 732 on motor add override timer 730 are set to logic 1 and the timer 730 will time out placing the output 733 to a logic 1, provided these conditions persist for the time on the motor override timer 730. The time of the motor add override timer 730 is set shorter than the time on the motor add timer 720 such that it will come on sooner if the pressure drops too much in tank 50. An output 733 to logic 1 forces the add motor timer to time out at 723 turning on the motor with "cr-seq mtr" 728.

During the timing of the motor add timer 720, if the air pressure in tank 50 begins increasing toward the set point at a rate greater than or equal to a programmed rate which is the minimum movement psi amount for a time interval, then "moving+to sp" relay 757 resets the timer of the add motor timer 720 as does the logic "0" of relay 756 cr-below. The motor add timer 720 will begin timing again when the "moving+to sp" 757 condition is not present and the cr-below condition on relays 756 and 715 is present while 710, 715 and 718 are true (logic 1).

Once the add motor timer 720 times out it can only be reset by the motor shed timer 750 timing out or the compressor being removed from the auto mode by auto relay 755. This is due to the latching conditions of 758 cr-seq motor in the reset circuit.

The motor shed timer 750 will time whenever the air pressure in tank 50 is more than the set point by ½ the deadband placing cr-above relay 742 to a logic 1, and the pressure is not dropping toward the set point at a programmed rate moving negatively to SP relay 740 and this compressor is not loaded as indicated at this compressor cr-seq load relay 741. Thus the pressure is not moving toward the set point at the moving to the set point rate, which is decreasing pressure at a rate equal to or greater than the minimum movement psi amount for the movement interval time.

If the air pressure in tank 50 increases to a value more than the psi set point by a value equal to or greater than the motor shed override PV offset value the high PV override relay 743 will be made and the motor shed override timer 760 will time. If this condition continues for the time of the motor shed override timer 760 then it will time out and will force the motor shed timer 750 to time out stopping the air compressor motor by resetting the motor add timer 720 to it's starting value.

Similarly for the motor shed reduced timer 770, when a still higher pressure is reached this will time. It has a shorter time setting so as to turn off the compressor motor sooner for the reduced PV high offset from the set point.

The timers 720, 730 have a minimum leave movement pressure amount logic function 717 and 718 such that when set to a number other than zero, causes the add timers to time only when the pressure is changing in the negative direction this amount or more for the movement interval of time. When the pressure movement is not at least this amount, the add timers hold up their timing. When the minimum leave movement pressure amount is set to zero then this logic function is de-activated and the logic works without this feature.

As with the add and shed motor logic of FIG. 7 the add and shed load logic of FIG. 8 has the same circuits and the same logic.

In FIG. 8 the logic of the add and shed load timers is shown. A circuit like this is assigned to every compressor. When the air pressure in tank 50 falls to a value less than the set point psi by more than ½ the deadband then the cr-below relay 815 is activated, placing it in a logic 1 condition. If the pressure in tank 50 is dropping from the set point by programmed rate or more when moving negatively from SP, relay 818 is activated and if this compressor has its motor on, activating this compressor cr-seq motor relay 810, then the add load timer 820 will time by the logic 1 input at timer input 821. This load add timer 820 will time when the time input 821 is a logic 1 and the time reset 822 is a logic 1.

When the time input 821 and the time reset 822 are booth kept at a logic 1 for the time set on the load add timer 820, it times out, setting the out state 823 to a logic 1. The compressor load is then turned on by cr-seq load 828. If the time reset input 822 does not remain at a logic 1 then the add load timer 820 is reset to it's starting value.

If the pressure in tank 50 falls to a lower level, then the load for the compressor may have to be turned on sooner. Therefore a PV low override relay 816, set at a lower pressure than cr-below relay 815, is activated for this condition. If the pressure is dropping from the set point at a programmed rate or more in moving negatively from SP, relay 817 is activated then both the timer input 831 and the reset input 832 on load add override timer 830 are set to logic 1 and the timer 830 will time out placing the out setting 833 to a logic "1", provided these conditions persist for the set time of this load override timer 830. The time of the load add override timer 830 is set shorter than the time on the load add timer 820 such that it will come on sooner if the pressure drops to the PV low override offset in tank 50. When timer 830 times out, output 833 goes to a logic "1" forcing add load timer 820 to time out and it's output 823 to a logic "1": this turns on cr-seq load which loads the compressor. During the timing of the load add timer 820, if the air pressure in tank 50 begins increasing toward the set point at a rate greater than or equal to a programmed rate which is the minimum movement psi amount for a time interval, then "moving+to sp" relay 857 resets the add load timer 820. The load add timer 820 will begin timing again when the "moving+to sp" 857 condition is not present and the cr-below condition or relay 856 and 815 is present, and 810, 815 and 818 are true (logic "1").

Once the add load timer 820 times out it can only be reset by the load shed timer 850 timing out or the compressor being removed from the auto mode by auto relay 855. This is due to the latching condition of 858 cr-seq load in the reset circuit.

The load shed timer 850 will time whenever the air pressure in tank 50 is above the set point ½ the deadband placing cr-above relay 842 to a logic 1, and the pressure is not dropping toward the set point at a programmed rate moving negatively to SP relay 840 and the following stage motor is not on as indicated by the following stage compressor cr-seq motor relay 841. Thus the pressure is not moving toward the set point at the moving to the set point rate, which is decreasing pressure at an amount equal to or greater than the minimum movement psi amount for the movement interval time.

If the air pressure in tank 50 increases to a value more than the psi set point by a value equal to or greater than the load shed override PV offset value, the high PV override relay 843 will be made and the load shed override timer 860 will time. If this condition continues for the time of the load shed override timer 860 then it will time out and will force the load shed timer 850 to time out turning off the air compressor load by resetting the load add timer 820 to it's starting value.

Similarly for the load shed reduced timer 870 when a higher pressure is reached this timer will time. It has a shorter time setting so as to turn off the compressor load sooner for the reduced PV high offset from set point.

FIG. 6 shows a front view of a control panel 500 which can be used with the controller 10. The control panel has a display 510 for displaying information such as which compressors are on, which are loaded and how long they have been on. The display can show the sequence of the compressors and what the set points are for the system, what the current pressure in the tank 50 is and other data of interest.

Keys 520 are for entering data to the controller. Some keys may be labeled for the type of entry to be made, other keys have numbers for selecting parameters for set points, sequence selection, dead band, rotation times, delay times, and offsets, which motors to use and other data which may be required to program the controller.

Switches 530 can be used to select if the compressor is to be used in automatic mode run by the controller or in manual mode where a user selects which compressors are running.

The controller parameters may be programmed by use of the keys on the control panel or by a remote computer.

If any of the compressors have more than one load/unload staging the same flow diagrams can be used for intermediate load settings.

In more complex systems the motor sizes and compressor sizes may be different. With compressors of different size if the controller alternates between a large and a small compressor in the order they are added and shed the controller will automatically find the best combination of the incremental use of compressors by a rotation of the compressors so that the appropriate size compressor will become the last lag compressor. For example if a large compressor is the last lag compressor when a smaller compressor will better handle the load variations, the large compressor may cycle its motor the allowable number of times and will rotate to the next compressor in the queue which may be a better size.

In the preferred embodiment the motors are the same size the controller will rotate the motors turned on and off in a linear end around order.

In the embodiments presented the pressure is tested continually as the controller goes through a separate flow chart for each compressor. Other controllers may have one flow chart and keep track of which compressors are in use differently.

In other embodiments the controller may calculate pressures during the time periods of the timers by an averaging method, a moving average method or use some other statistical means for calculating the pressure changes.

The parallel timers are programmed for descending time intervals as the pressure is leaving the set point so that the timeout time can vary and quickly lower the add or shed time delay if the PV departure from the set point escalates at a higher rate. The object is to provide short enough times on the timers to efficiently shut down the overcapacity quickly and add compressors when more pressure is needed quickly. The time delays should be long enough to eliminate large amounts of cycling on and off of the compressors and the loads due to pressure peaks and troughs. Similarly the pressure offset settings and rates of change settings should be large enough to prevent cycling and small enough to keep the pressure in the tank 50 within a reasonable dead band.

By adding and shedding motors and loads serially the system under normal load operating conditions prevents two or more unloaded compressors from running at the same time, to save energy.

While the preferred embodiment has been described with reference to a pneumatic air distribution system the controller described herein may be used for controlling compressors for air conditioning, refrigeration systems, chillers or other systems employing a plurality of compressors. The controller may also be used on a plurality of pumps for pumping fluids, on fans, or other systems with a plurality or devices such as generators, supplying a load.

Obviously, many modifications and variations of the present invention are possible in light of the above teachings. It is therefore to be understood that, within the scope of the appended claims, the invention may be practiced otherwise than as specifically described.

What is claimed is:

1. A method for controlling a plurality of electric motor-driven compressors in a pressure delivery system comprising:

sensing a pressure in a tank, comparing the sensed pressure to a set point representing the desired pressure in the tank, providing a dead band of pressure above and below the set point within which a tank pressure process variable is satisfied and no action is taken, controlling the on and off state of the plurality of electric motor-driven compressors and the loaded and unloaded state thereof, to add compressors to the system one at a time when the pressure is below the set point and unloading and turning off the plurality of electric motor-driven compressors one at a time when the pressure is above the set point to keep the tank pressure process variable near the set point, and controlling the load on the plurality of electric motor-driven compressors, to turn on each compressor, prior to loading it, and unload each electric motor-driven compressor before turning off each electric motor-driven compressor, in accordance with a programmed lead/lag sequence, such that the system has the least number of such compressors turned on and unloaded at one time, to maintain the desired pressure.

2. A method for controlling a plurality of electric motor-driven compressors in a pressure delivery system as in claim 1 and further comprising:

tracking the time of use of each of said compressors, and rotating the electric motor-driven compressors selected to be on such that they experience approximately the same amount of time of use.

3. A method for controlling a plurality of electric motor-driven compressors in a pressure delivery system as in claim 2 and further comprising:

tracking the number of on and off times for each of said compressors during a period of time, as well as a continuous totalization of the on-times and limiting the number of on and off cycles on one of the plurality of electric motor-driven compressors during a period of time by an extra rotation of the lead lag sequence.

4. A method for controlling a plurality of electric motor-driven compressors in a pressure delivery system as in claim 1 and further comprising:

tracking the number of on and off times for each of said compressors during a period of time, and rotating the lead/lag sequence in which compressors are turned on to limit the number of on and off cycles on a given compressor during a period of time.

5. A method for controlling a plurality of electric motor-driven compressors in a pressure delivery system as in claim 1 and further comprising:

controlling the on and off state of the plurality of said compressors and the load/unload state of said compressors by tracking the rate of pressure change in the tank in addition to the pressure in the tank.

6. A method for controlling a plurality of electric motor-driven compressors in a pressure delivery system as in claim 5 and further comprising:

dynamically delaying the change of each compressor's on and off state and load unload condition by use of pressure and rate of change of pressure parameters.

7. A method for controlling a plurality of electric motor-driven compressors in a pressure delivery system as in claim 6 and further comprising:

providing more than one set of delay times, pressure offsets and rate of change of pressure parameters to provide an override decision that descending to the lowest time delay for a change of said compressor on/off state and loading condition when pressures in the tank are changing rapidly such that decisions to change compressor on/off state can be made more rapidly in times of high fluctuation of pressure change rates.

8. A method for controlling a plurality of electric motor-driven compressors in a pressure delivery system as in claim 5 and further comprising:

providing at least two load levels on said compressors, the load levels selected by the controller such that the system can provide accurate delivery of pressure in the tank.

9. A method for controlling a plurality of electric motor-driven compressors in a pressure delivery system as in claim 1 further comprising:

tracking the total on time for each of the compressors in both the loaded and unloaded states to provide energy usage data and maintenance data.

10. A method for controlling a plurality of electric motor-driven compressors in a pressure delivery system as in claim 1 and further comprising:

providing a manual override to the controlling of the on and off state of the plurality of compressors such that a selected compressor can be individually controlled manually without affecting the functioning of the controls on the remaining ones of the plurality of compressors.

11. A method for controlling a plurality of electric motor-driven compressors in a pressure delivery system as in claim 1 and further comprising:

providing a manual override to the controlling on and off state of the plurality of compressors such that a selected one of the plurality of compressors can be individually controlled without affecting the functioning of the controls on the balance of the compressors.

12. A control system for controlling the delivery of fluid under pressure to a tank from a plurality of electric motor-driven compressors comprising:

(a) a pressure sensor for measuring the fluid pressure within the tank as a process variable;

(b) a comparator for comparing the process variable to a process variable set point; and (c) means for controlling the on/off state and the load/unload state of the plurality of compressors to turn on compressors, one at a time, and to subsequently load the turned-on compressor in accordance with the predetermined lead/lag schedule when the tank pressure is below the process variable set point and to first unload and then turn off compressors, one at a time in a predetermined order when the tank pressure is above the process variable set point whereby a minimum number of compressors are in a turned on and unloaded state at any given time while maintaining the process variable within a predetermined range of the process variable set point.

13. The control system of claim 12 wherein said predetermined range is defined by a dead band parameter stored within the means for controlling the on/off state and the load/unload state of the plurality of compressors.

14. The control system of claim 12 wherein the predetermined order is such that the last compressor to be turned on and loaded when the process variable is less than the process variable set point is the first compressor to be unloaded and then turned off when the process variable is above the process variable set point.

15. The control system of claim 14 wherein said first compressor is turned off before a next compressor is unloaded when the unloading and turning off the first compressor fails to bring the process variable below the process variable set point.

16. The control system of claim 12 and further including a timer for recording the individual running time of each of the plurality of compressors.

17. The control system of claim 12 and further comprising:

means for altering the lead/lag schedule so that the individual compressors have a generally equal on time.

18. The control system of claim 12 and further including:

means for altering the lead/lag schedule such that no one compressor is turned on more than a predetermined number of times in a given time period.

* * * * *